US006833015B2

(12) United States Patent
Oh et al.

(10) Patent No.: US 6,833,015 B2
(45) Date of Patent: Dec. 21, 2004

(54) CYCLONE-TYPE DUST-COLLECTING APPARATUS FOR USE IN A VACUUM CLEANER

(75) Inventors: Jang-keun Oh, Gwangju (KR); Hyun-ju Lee, Jeonju (KR); Sung-tae Joo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 99 days.

(21) Appl. No.: 10/272,211

(22) Filed: Oct. 16, 2002

(65) Prior Publication Data

US 2003/0221280 A1 Dec. 4, 2003

(30) Foreign Application Priority Data

Jun. 4, 2002 (KR) ..... 10-2002-31273

(51) Int. Cl.[7] ..... B01D 45/12

(52) U.S. Cl. ..... 55/337; 15/353; 55/424; 55/426; 55/DIG. 3

(58) Field of Search ..... 55/DIG. 3, 337, 55/429, 424, 426, 430; 95/268; 15/353

(56) References Cited

FOREIGN PATENT DOCUMENTS

GB 2381223 4/2003

*Primary Examiner*—Duane S. Smith
(74) *Attorney, Agent, or Firm*—Ladas & Parry LLP

(57) ABSTRACT

A cyclone-type dust-collecting apparatus for use in a vacuum cleaner has a cyclone body having an inflow port and an outflow port, the cyclone body being capable of forming a whirling air current from dust-laden air drawn into the vacuum cleaner through the inflow port; a dust-collecting chamber being removably connected with the cyclone body, for collecting dust separated from the drawn air in the whirling air current; and a grill assembly disposed at the outflow port of the cyclone body for preventing a reverse flow of dust through the outflow port of the cyclone body. The grill assembly has a first grill member having a supporting portion supported on the outflow port of the cyclone body; a second grill member removably connected to a lower opening of the first grill member; and a grill portion provided to define a passage in fluid communication with the outflow port in an outer circumference of the second grill member.

16 Claims, 11 Drawing Sheets

CYCLONE-TYPE DUST-COLLECTING APPARATUS FOR USE IN A VACUUM CLEANER

BACKGROUND OF THE INVENTION

1. Field of the Invention

The present invention relates generally to a vacuum cleaner, and more particularly, it relates to a cyclone-type dust-collecting apparatus for use in a vacuum cleaner capable of separating various contaminants (hereinafter collectively called 'dust') from an air drawn through a suction portion of the vacuum cleaner by using a centrifugal force of a whirling air current it causes from the drawn air.

2. Description of the Background Art

One example of a cyclone-type dust collecting apparatus for use in vacuum cleaner is disclosed by commonly assigned U.S. Pat. No. 6,195,835, the structure of which is schematically shown in the accompanying drawings FIGS. 1 through 4.

As shown in FIGS. 1 through 4, the cyclone-type dust collecting apparatus for use in a vacuum cleaner generally includes a cyclone body 20, a dust-collecting chamber 30 and a grill assembly 40.

The cyclone body 20 is divided into an upper body 21 and a lower body 22, which are connected to each other by a plurality of screws 23. The lower body 22 has an inflow pipe 24 connected to an extension pipe 1*a* itself connected to a suction port of the vacuum cleaner (not shown), and an inflow port 25 in fluid communication with the inflow air pipe 24. The upper body 21 has an outflow pipe 26 connected to the extension pipe 1*b* extending toward a body of the cleaner, and an outflow port 27 in fluid communication with the outflow pipe 26. Dust-laden air is drawn into the cleaner through the suction port in a diagonal direction with respect to the cyclone body 20, thereby forming a cyclonic whirling air current inside of the cyclone body 20. The centrifugal force of the whirling air current causes the dust to be separated from the air.

The dust collecting chamber 30 is removably connected to the cyclone body 20, functioning to generate a whirling air current in cooperation with the cyclone body 20, and also to collect the dust separated from the air by the whirling air current.

The grill assembly 40 is mounted at the outflow port 27 of the cyclone body 20, preventing reverse flow of the dust that is collected in the dust-collecting chamber 30, through the outflow port 27. The grill assembly 40 has a grill body 41, a grill portion 42 formed along the outer circumference of the grill body 41 to define a passage in fluid communication with the outflow port 27, and a dust reverse flow preventing portion 43, in the shape of a cone and formed at a lower end of the grill body 41. An upper portion 41*a* of the grill body 41 is supported between the upper and lower bodies 21, 22 of the cyclone body 20 so that the grill assembly 40 can be mounted at the outflow port 27 of the cyclone body 20. The grill portion 42 is formed by penetrating a plurality of fine holes along the outer circumference of the grill body 41.

In the cyclone-type dust-collecting apparatus for use in the vacuum cleaner, the dust-laden air is drawn by the suction force generated at the suction port of the cleaner and directed into the cyclone body 20 through the inflow port 25. The air flowing into the cyclone body 20 in a diagonal direction descends in the dust-collecting chamber 30 in a whirling current (curved arrow-headed solid line of FIG. 1). During this process, dust is separated from the air by the centrifugal force of the whirling current, and is collected in the dust-collecting chamber 30.

Upturning air from the bottom of the dust-collecting chamber 30 is discharged to the cleaner body via the grill portion 42 of the grill assembly 40, the outflow port 27 and the outflow pipe 26 (—shown by phantom arrow of FIG. 1). Some dust still remaining in the upturning air current of the dust-collecting chamber 30 is blocked by the dust reverse flow preventing portion 43 extending toward the whirling air current. Dust still remaining in the air, even after the dust reverse flow preventing portion 43 is discharged through the grill portion 42 of the grill assembly 40, becomes entrained in the discharged air. Among such dust, some dust particles, which are larger than the fine holes of the grill portion 42, are blocked by the grill portion 42 and are returned to the whirling current.

The dust-laden air drawn into the cyclone body 20 can contain very fine dust particles, and as these are very light, the fine dust particles are rarely separated by the centrifugal force of the whirling air. Accordingly, the fine dust particles still remain in the air, and eventually block the grill portion 42 as the air is discharged through the grill portion 42. As the grill portion 42 is blocked, suction force is from the motor is reduced, and thus, the suction efficiency deteriorates.

Usually, such dust at the grill portion 42 remains even after the cleaning operation, causing the same or decreased suction efficiency in the next cleaning operation. Accordingly, such dust particles have to be dealt with on a regular basis, which means expending labor and time have for device cleaning or maintenance.

In the conventional cyclone-type dust-collecting apparatus, as the grill assembly 40 is supported between the upper and lower bodies 21, 22 of the cyclone body 20, it is difficult for a user to remove the grill assembly 40. Accordingly, cleaning or repairing of the grill assembly 40 is a complicated operation. Also, while wiping the grill assembly 40 after it has been removed, the user usually experiences discomfort since he/she has the dust on his/her hands. In addition, the dust normally falls in an area around the user, thereby polluting the surrounding area. Yet another problem is that the user usually requires many time and labor to clean the grill assembly 40 completely. All these problems will definitely result in a device that is undesirable to a purchaser.

Still another problem of a vacuum cleaner employing such a conventional cyclone-type dust-collecting apparatus is that the vacuum cleaner is difficult to use and handle. More specifically, as shown in FIG. 3, the user cleans the required area with his/her hands holding a grip G provided adjacent the extension pipe 1*b* on the side toward the cleaner body. It is very hard for the user to dean the area while moving the suction port E, connected with the cyclone-type dust-collecting apparatus, only with one hand. Automatically, the user usually holds the extension pipe with his/her other hand as shown in FIG. 3, which is inconvenient. Because there is no separate handle or part attached to the dust-collecting apparatus to hold it with, it is usually difficult for the user to perform the cleaning operation or to handle the cleaner. Reference character CB in FIG. 3 denotes the cleaner body and a cyclone-type dust-collecting apparatus S is mounted between the extension pipes 1*a*, 1*b*.

In the cyclone-type dust-collecting apparatus as described above, cleaning efficiency depends on the whirling air current generated inside of the cyclone body 20. The whirling air current with stable directionality can contribute to superior cleaning efficiency. In the conventional cyclone-type dust-collecting apparatus, however, airflow of directionalities may be different from those that are desired. The desired air current, indicated by an arrow A in FIG. 4, is the flow moving along an inner circumference 22*a* of the lower body 22 of the cyclone body 20. Here, airflow of different and undesirable directionalities are indicated by the arrows B and C in FIG. 4. Most of time, the air currents B and C would eventually follow the desired direction A. The problem is that during at least a portion of the operation, unstable currents moving in different directions arise that interfere with the desired air flow and thus cause a reduction in efficiency.

SUMMARY OF THE INVENTION

Accordingly, it is an object of the present invention to provide a cyclone-type dust-collecting apparatus for use in a vacuum cleaner, thereby increasing the ease in cleaning and repairing a grill assembly, and further, in using and handling the vacuum cleaner.

Another object is to provide a cyclone-type dust-collecting apparatus for use in a vacuum cleaner, having an enhanced efficiency by maximizing stability and directionality of a whirling current generated in a cyclone body.

The above-mentioned objects are accomplished by a cyclone-type dust-collecting apparatus for use in a vacuum cleaner according to the present invention, including a cyclone body having an inflow port and an outflow port, the cyclone body being capable of forming a whirling air current from dust-laden air drawn into the vacuum cleaner through the inflow port; a dust collecting chamber removably connected with the cyclone body for collecting dust separated from the drawn air in the whirling air current; and a grill assembly disposed at the outflow port of the cyclone body for preventing a reverse flow of the dust through the outflow port of the cyclone body. The grill assembly includes a first grill member having a supporting portion supported on the outflow port of the cyclone body; a second grill member removably connected to a lower opening of the first grill member; and a grill portion defining a passage in fluid communication with the outflow port in an outer circumference of the second grill member.

The second grill member having the grill portion, i.e., the portion that is easily contaminated by the dust, is removably screwed to the first grill member that is secured to the cyclone body. Accordingly, the user can remove the dust over the grill portion after simply separating the second grill member. As the user can clean the grill portion of the grill assembly in a convenient way, cleaner maintenance and care can be performed easily.

According to a preferred embodiment of the present invention, the first grill member comprises a female-screw portion formed on an inner circumference of the lower opening, and the second grill member comprises a male-screw portion formed on an outer circumference of upper portion corresponding to the female-screw portion.

The grill portion is formed by fitting a mesh filter into the second grill member, the mesh filter comprising a plurality of fine holes, and the second grill member comprising a plurality of window-shaped openings formed in the outer circumference in a radial direction.

The mesh filter comprises: a filter frame comprising an upper ring, a lower ring, and two or more ribs connecting upper and lower rings; and a net insert-molded into the filter frame so as to be placed in openings partitioned by the ribs of the filter frame.

The filter frame may be formed of a plastic, and upper and lower rings of the filter frame are vapor-deposited onto a corresponding portion of the second grill member so that the filter frame is inserted in the second grill member, thereby constituting the mesh filter.

The filter frame may comprise rubber, and produce an interference-fit in the second grill member, thereby constituting the mesh filter.

The grill portion may be formed by direct boring a plurality of fine holes in the outer circumference of the second grill member.

According to another preferred embodiment of the present invention, the grill assembly comprises a dust reverse flow preventing member disposed at the lower opening of the second grill member for deflecting the dust entrained in the upwardly directed air current of the dust collecting chamber.

The dust reverse flow preventing member comprises: a cylinder press fit through the lower opening of the second grill member, and comprising upper and lower supporting portions having two or more ribs; a shaft supported by upper and lower supporting portions; and a plate connected to an end of the shaft, disposed at a predetermined distance from a lower end of he second grill member.

The cylinder comprises a spiral guide formed therein for guiding a flow of air being discharged therethrough. The cylinder and the plate may be formed of rubber.

The plate may comprise a conical or frusto-conical shape.

According to yet another preferred embodiment of the present invention, the cyclone body comprises a secondary handle protruding from an extension pipe of the vacuum cleaner to enable a user to grip the extension pipe. The user can perform the cleaning operation conveniently, with one hand holding the grip of the extension pipe and the other hand holding the secondary handle.

The cyclone body may comprise upper and lower bodies which are separately formed and mate with each other, and the secondary handle may comprise a pair of handle portions having symmetrical shapes formed on upper and lower bodies and mated with each other.

Another object is accomplished by the cyclone body comprising a guiding surface formed at a sidewall of the inflow port, for guiding the flow of air drawn in through the inflow port and thereby improving the directionality of the drawn air, the guiding surface being formed at a predetermined radius of curvature.

Stability and directionality of the whirling air current in the cyclone body are improved, and efficiency in operation and reverse flow prevention can be expected.

The radius of curvature of the guiding surface is smaller than the radius of curvature of the inner circumference of the cyclone body.

BRIEF DESCRIPTION OF THE DRAWINGS

The above-mentioned objects and the feature of the present invention will be more apparent by describing the preferred embodiment of the present invention in detail referring to the appended drawings, in which.

DETAILED DESCRIPTION OF PREFERRED EMBODIMENTS

Figure 1:
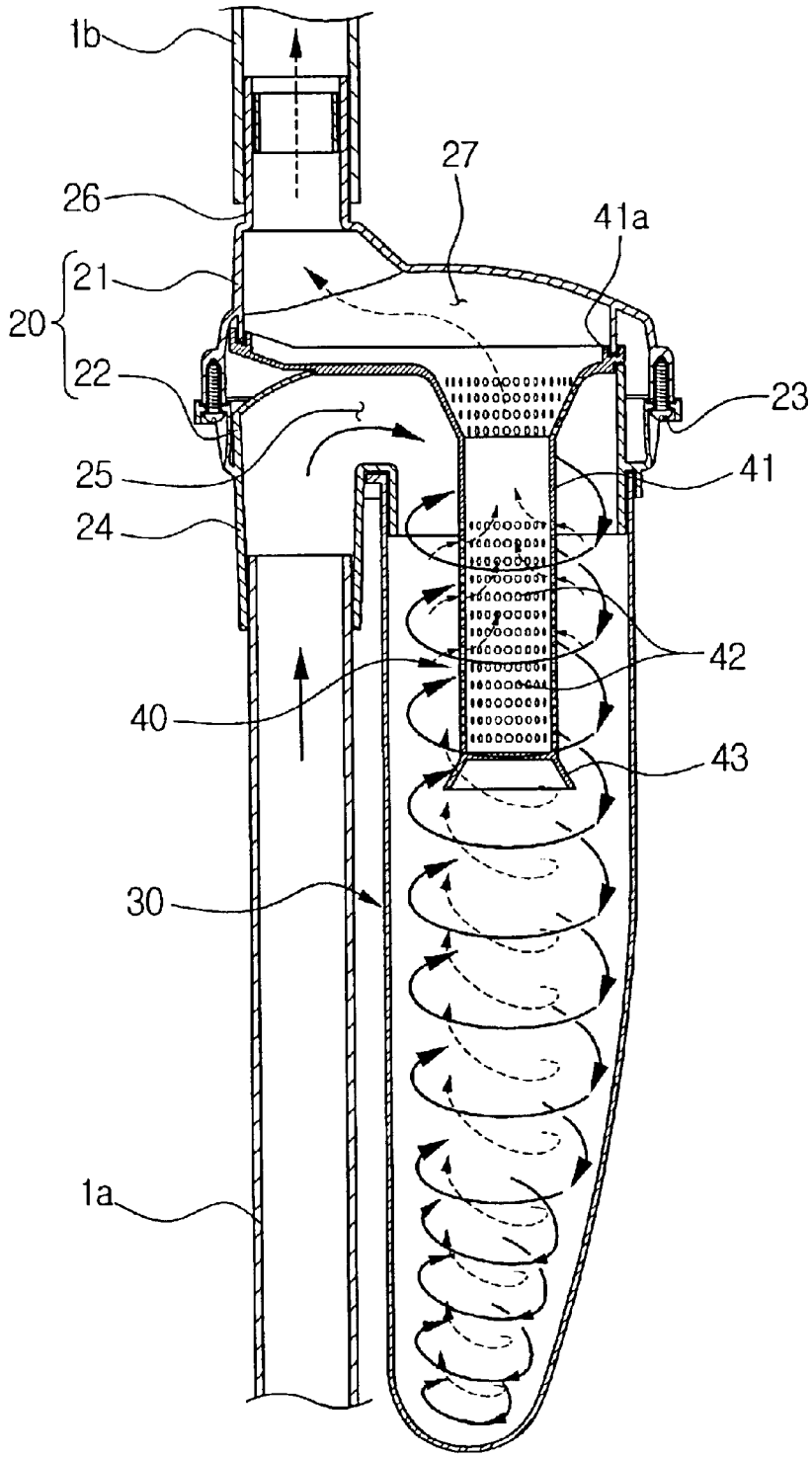
FIG. 1 (PRIOR ART)
FIG. 1 is a sectional view showing the construction and operation of a conventional cyclone-type dust-collecting apparatus.
Figure 2:
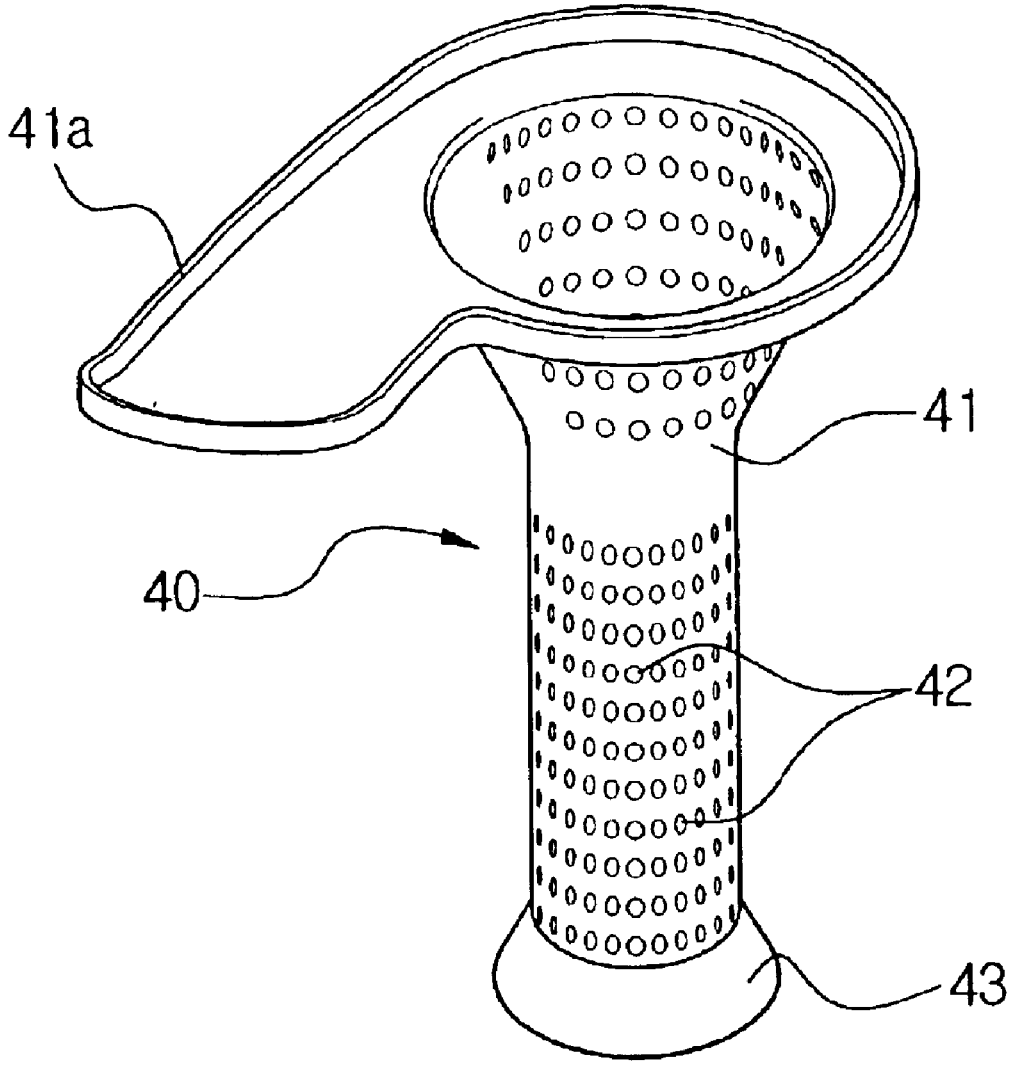
FIG.2 (PRIOR ART)
FIG. 2 is a perspective view of a grill assembly of the conventional cyclone-type dust-collecting apparatus of FIG. 1.
Figure 3:
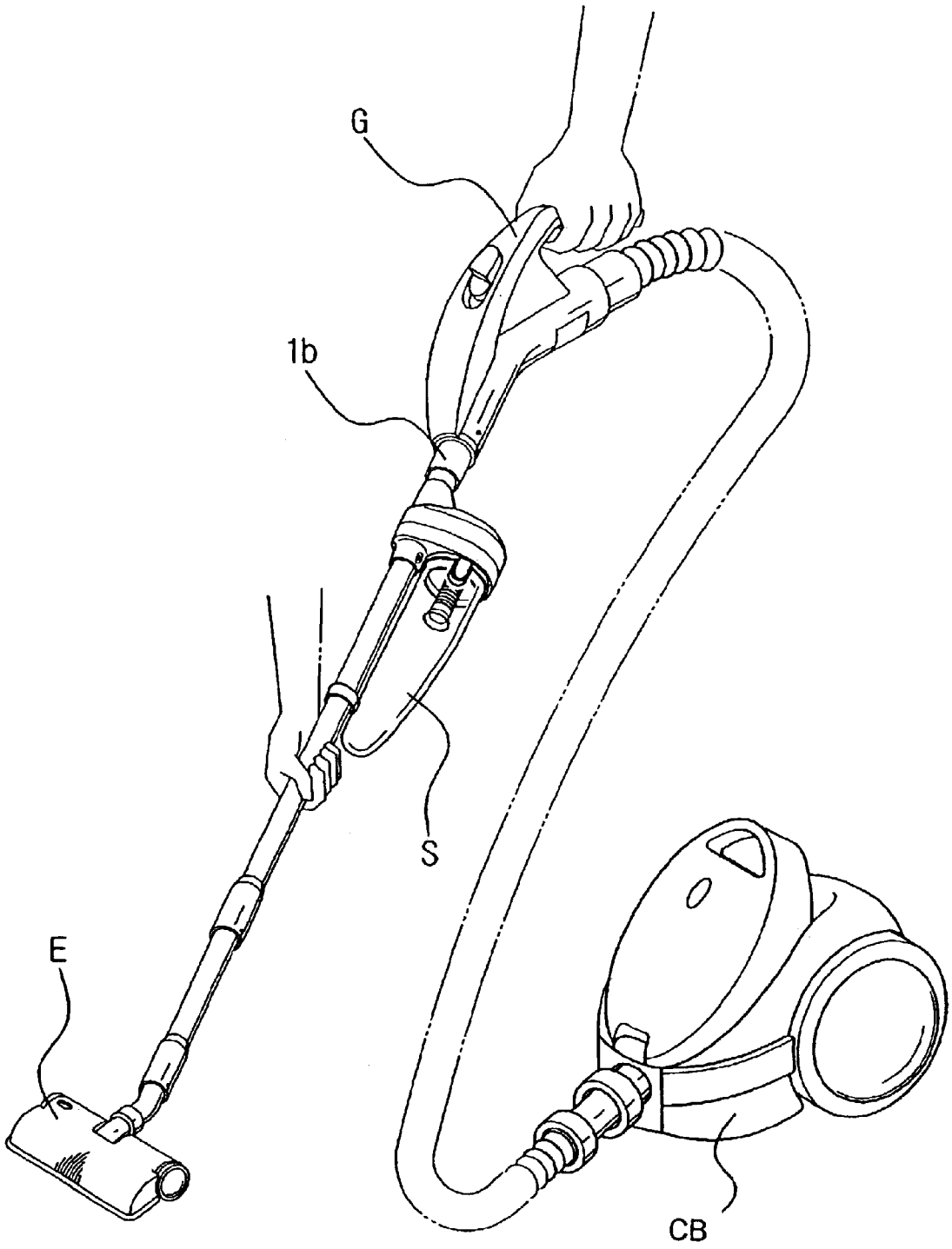
FIG.3 (PRIOR ART)
FIG. 3 is a perspective view showing the vacuum cleaner employing the cyclone-type dust-collecting apparatus of FIG. 1 therein during operation.

The present invention will be described in greater detail with reference to the accompanying drawings. Throughout the description, like elements with the similar functions will be given the same reference numerals as those of provided in the description of the conventional vacuum cleaner of FIGS. 1–4 set forth above.

Figure 5:
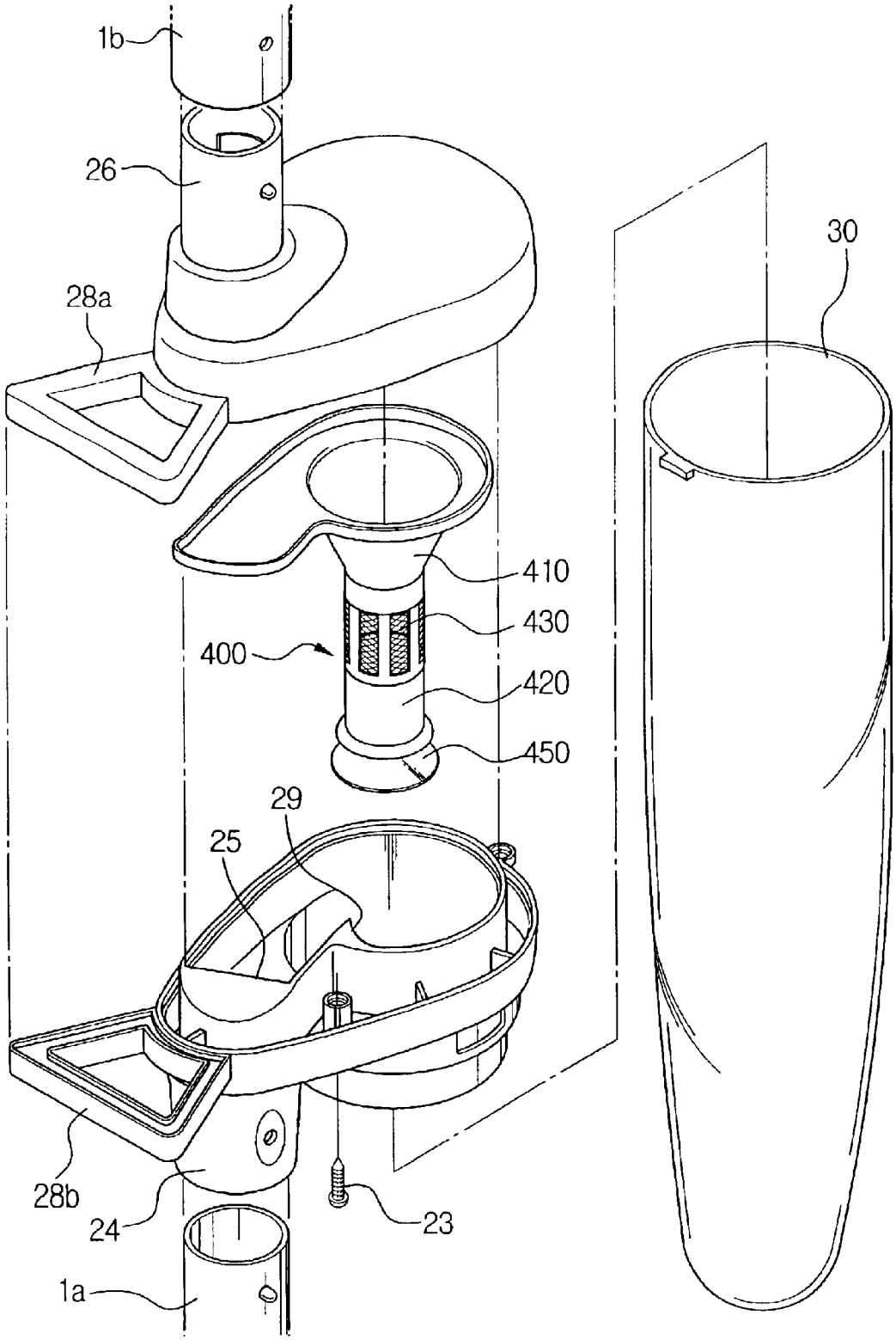
FIG. 5 is an exploded perspective view of a cyclone-type dust-collecting apparatus for use in vacuum cleaner according to the preferred embodiment of the present invention.
Figure 10:
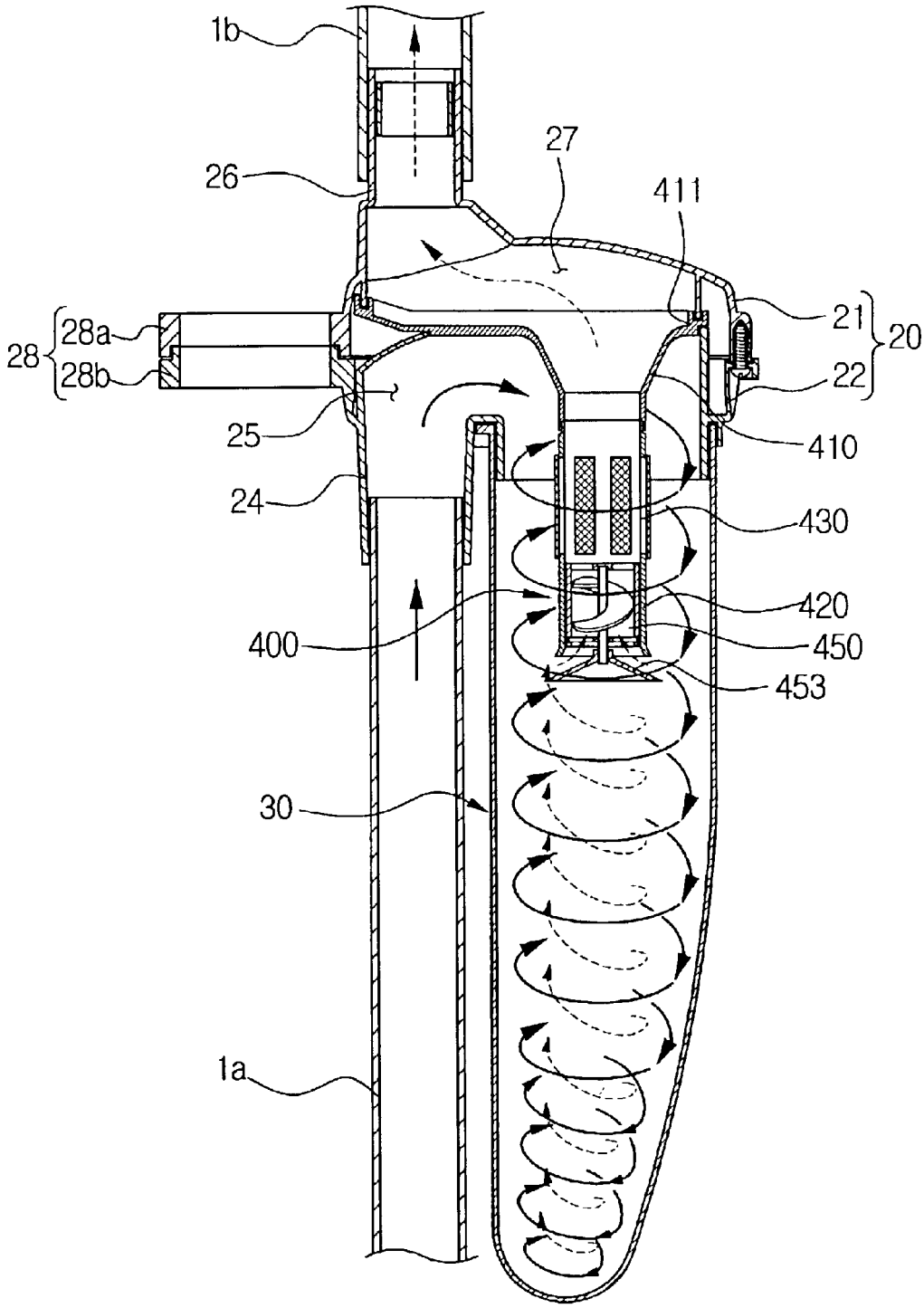
FIG. 10 is a sectional view showing the operation of the cyclone-type dust-collecting apparatus for use in vacuum cleaner according to the preferred embodiment of the present invention.

As shown in FIGS. 5 and 10, the cyclone-type dust collecting apparatus according to the preferred embodiment of the present invention includes a cyclone body 20, a dust-collecting chamber 30 and a grill assembly 400.

The cyclone body 20 is divided into upper and lower bodies 21, 22, which are connected to each other by a plurality of screws 23. The lower body 22 has an inflow pipe 24 connected to an extension pipe 1*a* extending toward a suction port of the vacuum cleaner, and an inflow port 25 in fluid communication with the inflow pipe 24. The upper body 21 has an outflow pipe 26 connected to the extension pipe 1*b* extending toward a body of the cleaner, and an outflow port 27 in fluid communication with the outflow pipe 26.

Figure 12:
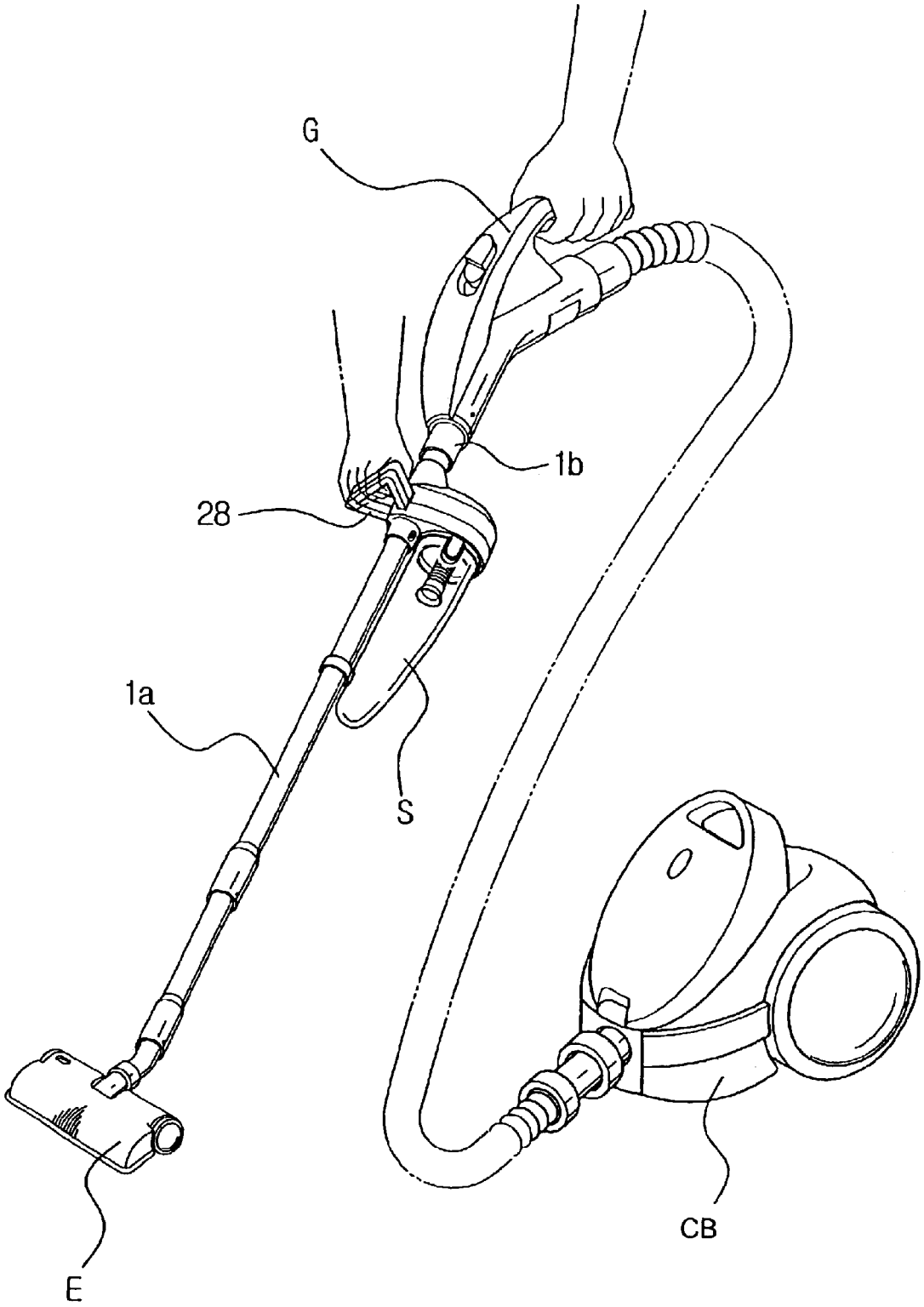
FIG. 12 is a perspective view showing the vacuum cleaner during a cleaning operation employing the cyclone-type dust-collecting apparatus according to the preferred embodiment of the present invention.

According to one aspect of the present invention, the cyclone body 20 includes a secondary handle 28. As shown in FIG. 12, the secondary handle 28 protrudes when the cyclone-type dust-collecting apparatus S is mounted between the extension pipes 1*a*, 1*b*, allowing for gripping by a user. Accordingly, the user can perform the cleaning operation more easily, i.e., with one hand holding the grip G of the extension pipe and the other hand holding the secondary handle 28.

As shown in FIGS. 5 and 10, the secondary handle 28 consists of a pair of handle portions 28*a*, 28*b*, which are integrally formed on the upper and lower bodies 21, 22 in symmetrical shape with each other. Albeit not shown, the secondary handle 28 can also be formed in the form of separate parts that are connected to the cyclone body 20. The shape of the secondary handle 28 should not be considered as limiting, however, since the secondary shape 28 can be formed in various shapes, provided that it is easy for the user to grip.

Figure 6:
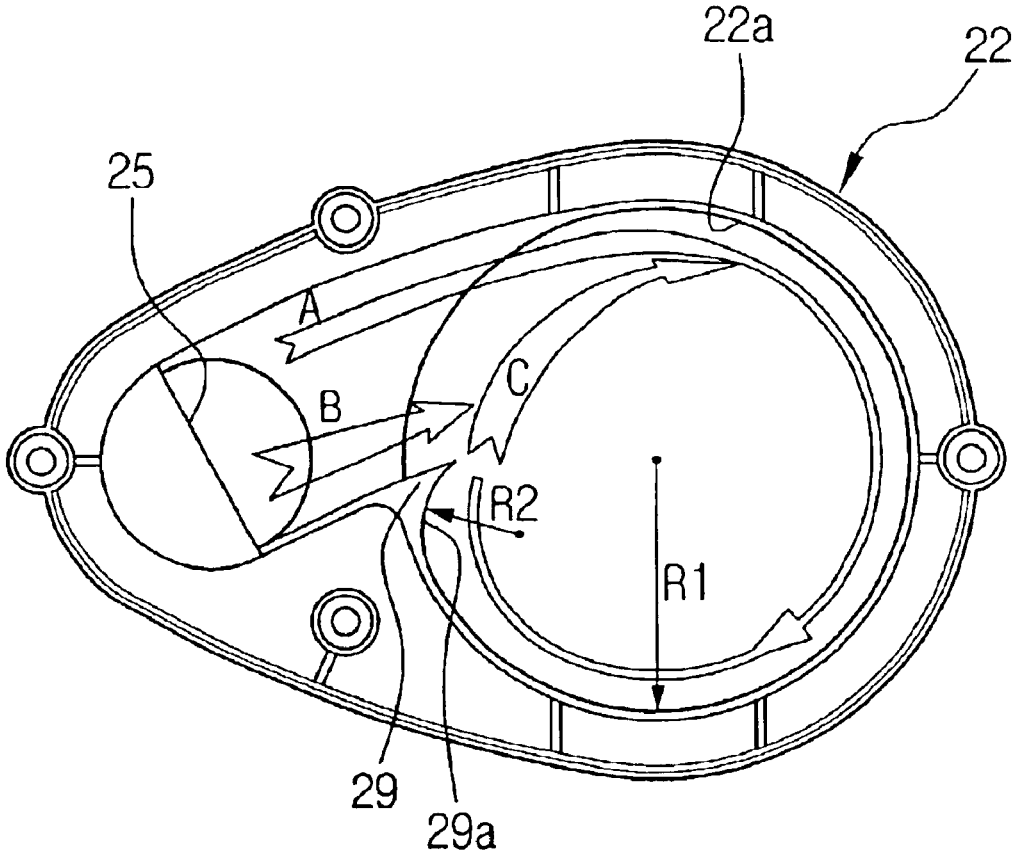
FIG. 6 is a plan view showing the lower cyclone body, indicating the directionality of the whirling air current in the cyclone-type dust-collecting apparatus of FIG. 5.

According to another aspect of the present invention, as shown in FIG. 6, the cyclone body 20 has a guiding member 29 formed at one side of the inflow port 25 of the lower body 22. The guiding member 29 has a guiding surface 29*a* formed with a predetermined radius of curvature R2. The radius of curvature R2 of the guiding surface 29*a* is preferably smaller than the radius of curvature R1 of the inner circumference 22*a* of the lower body 22.

During operation of the vacuum cleaner, dust-laden air is drawn into the cleaner through the suction port, and into the cyclone body 20 through the inflow port 25 in an oblique or diagonal direction. Whirling air current is generated in the cyclone body 20, and the dust is separated from the air by the centrifugal force of the whirling air. Here, the desired air current flowing in the direction of arrow A is rotated within the cyclone body 20, while undesired air current in the direction of arrow C, which occurs after one rotation of air current A, is guided along the guiding surface 29*a* of the guiding member 29 to follow the desired air current A. Another undesired air current, shown by the direction of arrow B, is also guided along the guiding member 29 to follow the desired direction of arrow A.

Figure 4:
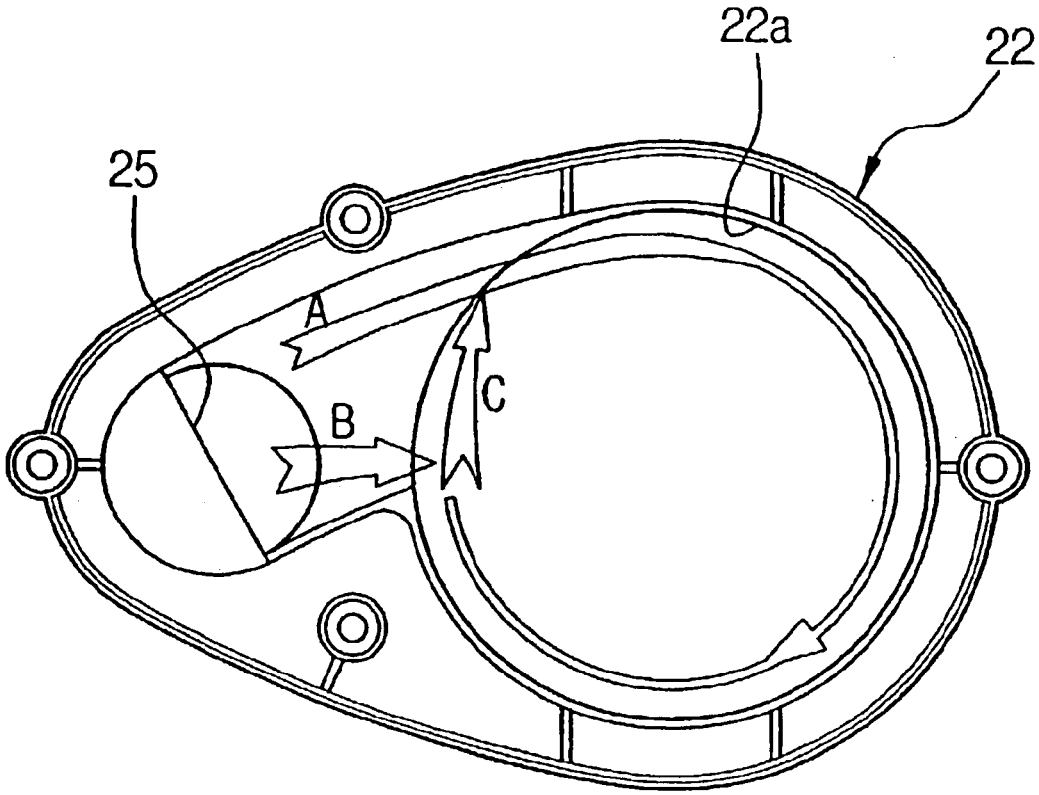
FIG.4 (PRIOR ART)
FIG. 4 is a plan view showing a lower cyclone body, indicating the directionality of the whirling air current in the conventional cyclone-type dust-collecting apparatus for use in the conventional vacuum cleaner of FIG. 1.

Conventionally, and as shown in FIG. 4, the air currents of undesired directionalities move in the direction interfering with the desired air current, shown by directionality A. According to the present invention, as the air current flows B, C are guided to follow the desired direction A, so that a more stable whirling air current is guaranteed, and the directionality of the air current improves. Accordingly, reverse flow of dust and inefficient operation can be effectively minimized or prevented. The dust-collecting chamber 30 is removably connected to the cyclone body 20, and functions to generate a whirling air current from the drawn air in cooperation with the cyclone body 20, and also to collect the dust which is separated from the air by the centrifugal force of the whirling air current.

The grill assembly 400 is mounted at the outflow port 27 of the cyclone body 20, to prevent dust collected by the dust-collecting chamber 30 from reverse flowing through the outflow port 27.

Figure 7:
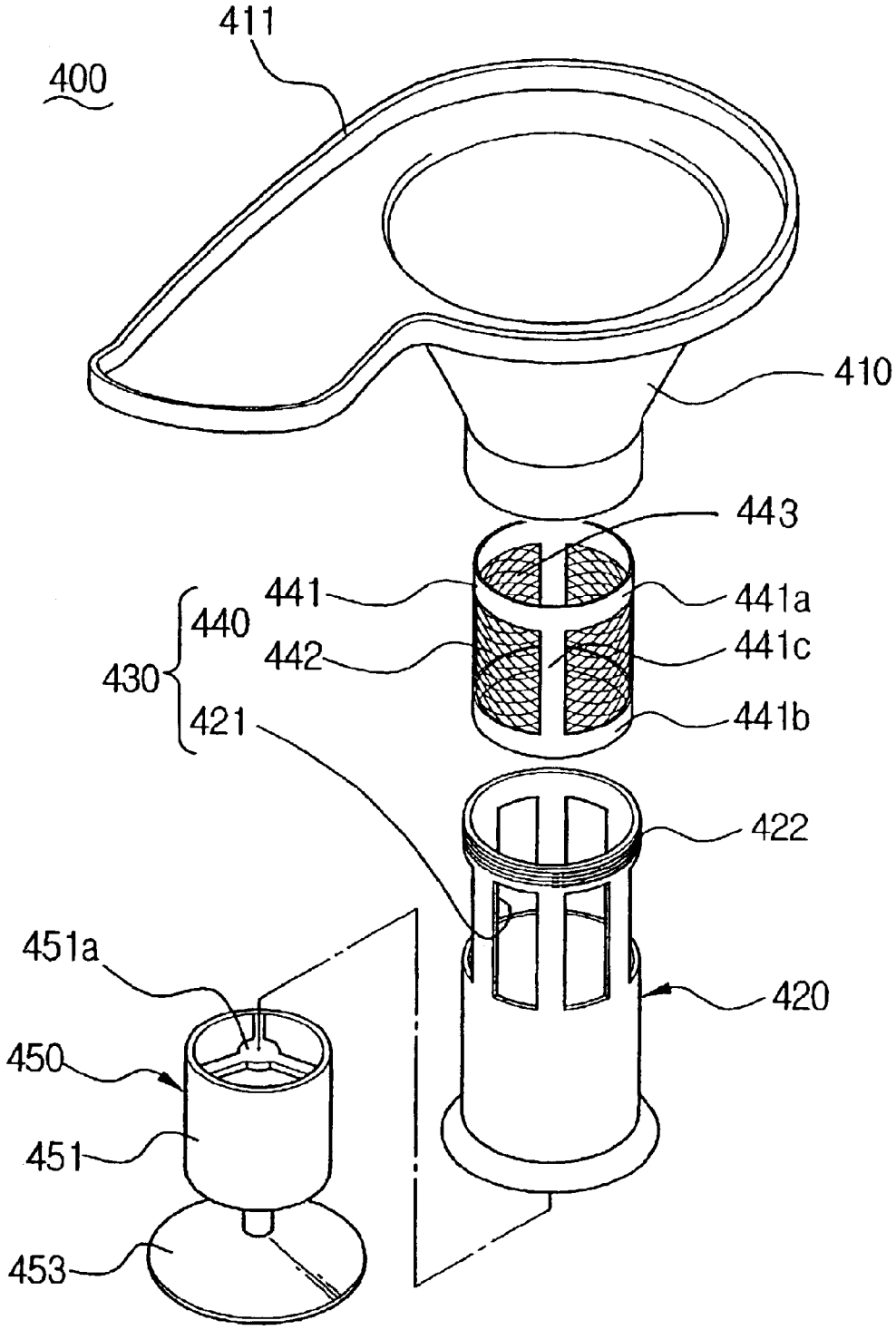
FIG. 7 is an exploded perspective view of a main part of the first preferred embodiment, illustrating the grill assembly of the cyclone-type dust-collecting apparatus of FIG. 5.
Figure 8:
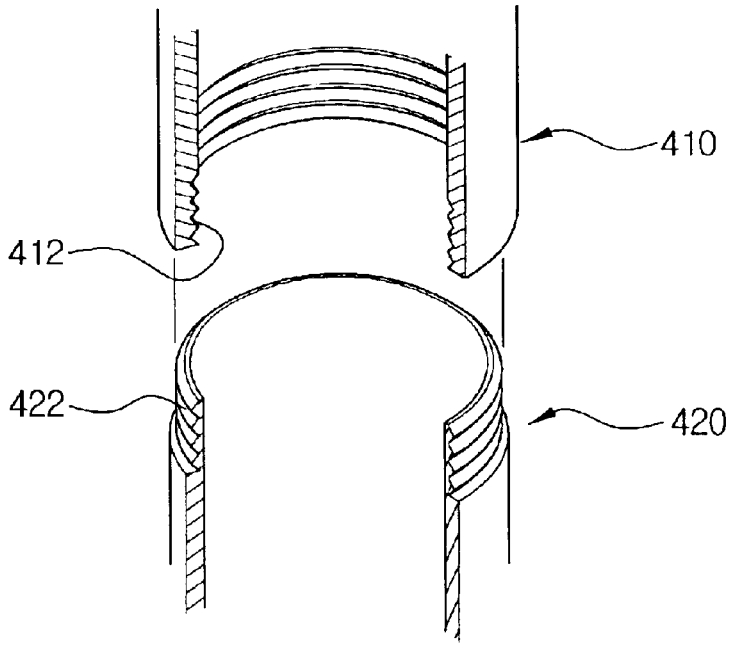
FIG. 8 is a partially cut-away, exploded perspective view showing the connecting structure of the first and second grill members of the grill assembly of FIG. 7.

According to an aspect of the present invention, as shown in FIGS. 7 and 8, the grill assembly 400 includes first and second grill members 410, 420, and a grill portion 430 formed adjacent the second grill member 420.

The first grill member 410 has a supporting portion 411 supported on the outflow port 27 of the cyclone body 20, and is mounted on the outflow port 27 as the supporting portion 411 is supported in between the upper and lower bodies 21, 22 of the cyclone body 20. The lower portion of the first grill member 410 is open, and has a female screw portion 412 (FIG. 8) preferably formed in an inner circumference of the open portion.

The second grill member 420 has a cylindrical shape, and a plurality of window-shaped openings 421 formed in a radial direction. The second grill member 420 also has a male-screw portion 422, corresponding to the female-screw portion of the first grill member 410. Accordingly, the second grill member 420 is removably connected to the first grill member 410.

The grill portion 430 defines a plurality of passages which correspond to the outer circumference of the second grill member 420, and communicate with the outflow port 27. The grill portion 430 includes a plurality of openings 442, which communicate with the plurality of window-shaped openings 421 of the second grill member 420, and a mesh filter 440 having a plurality of fine holes, which is fit around the plurality of openings 442. Although the mesh filter 440 is used in the embodiment shown in FIGS. 7 and 8, this is by way of an example and thus, should not be considered as limiting. For example, fine holes can be bored directly in the outer circumference of the second grill member 420, or the grill portion 430 can be formed by disposing a plurality of blades in the openings 421 of the second grill member 420. The mesh filter 440 includes a filter frame 441 and a net 443 for covering the openings 442. The filter frame 441 includes an upper ring 441*a*, a lower ring 441*b* and two or more ribs 441*c* connecting upper and lower rings 441*a*, 441*b*. The net 443 is insert-molded into the filter frame 441 to be placed in the openings 442 partitioned by the ribs 441*c* of the filter frame 441.

The filter frame 441 can be formed of plastic, for example, by injection molding, or can be formed of rubber. In order to fit the mesh filter 440, having the filter frame 441 formed of plastic by injection molding, into the second grill member 420, the mesh filter 440 is mounted in the second grill member 420, and the upper and lower rings 441*a*, 441*b* may be vapor-deposited on the corresponding portion of the second grill member 420. The mesh filter 440, having the filter frame 441 formed of rubber, is fit into the second grill member 420 without requiring a separate vapor-depositing step, as it can be simply force-fit in the second grill member 420.

Figure 9:
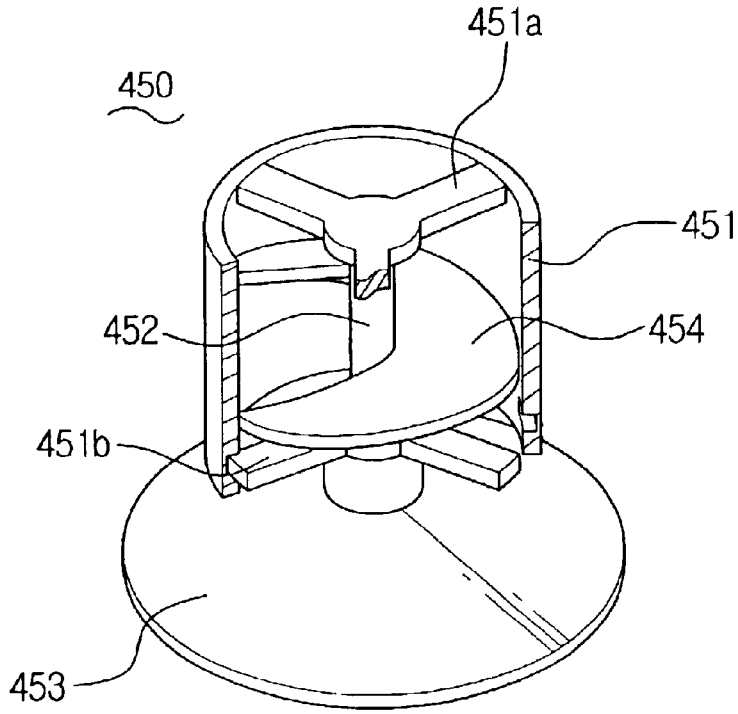
FIG. 9 is a partially cut-away, perspective view showing the structure of a dust reverse flow-preventing member of the cyclone-type dust-collecting apparatus according to the preferred embodiment of the present invention.

According to the preferred embodiment of the present invention, the grill assembly 400 further includes a dust reverse flow preventing member 450 formed at a lower portion of the second grill member 420, to deflect the dust entrained in the upturning air current of the dust-collecting chamber 30, into the whirling air current. In the case of employing the dust reverse flow preventing member 450, the lower portion of the second grill member 420 is open, and the dust reverse flow preventing member 450 is disposed in the open portion of the second grill member 420. As shown in FIG. 9, the dust revere flow preventing member 450 includes a cylinder 451, a shaft 452 and a plate 453.

As shown in FIGS. 7 and 10, the cylinder 451 is force-fit through the lower opening of the second grill member 420, and has upper and lower supporting portions 451*a*, 451*b*, respectively, each having two or more ribs. Although the number of ribs are not limiting, it is preferred to use three (3) ribs. The shaft 452 is supported by the upper and lower supporting portions 441*a*, 441*b*, and the plate 453 is connected to an end of the shaft 452. The plate 453 is formed at a predetermined distance from the lower end of the second grill member 420. Accordingly, the upturning air current of the dust collecting chamber 30 can flow into the second grill member 420 through a clearance defined by the lower end of the second grill member 420 and the plate 453.

A spiral guide 454 is formed within the cylinder 451, so as to guide the flow of air being discharged therethrough.

For easier assembly, the cylinder 451 and the plate 453 are formed of a flexible material, for example, rubber, and also, the plate 453 is preferred to be formed in a conicalor frusto-conical shape.

Figure 11:
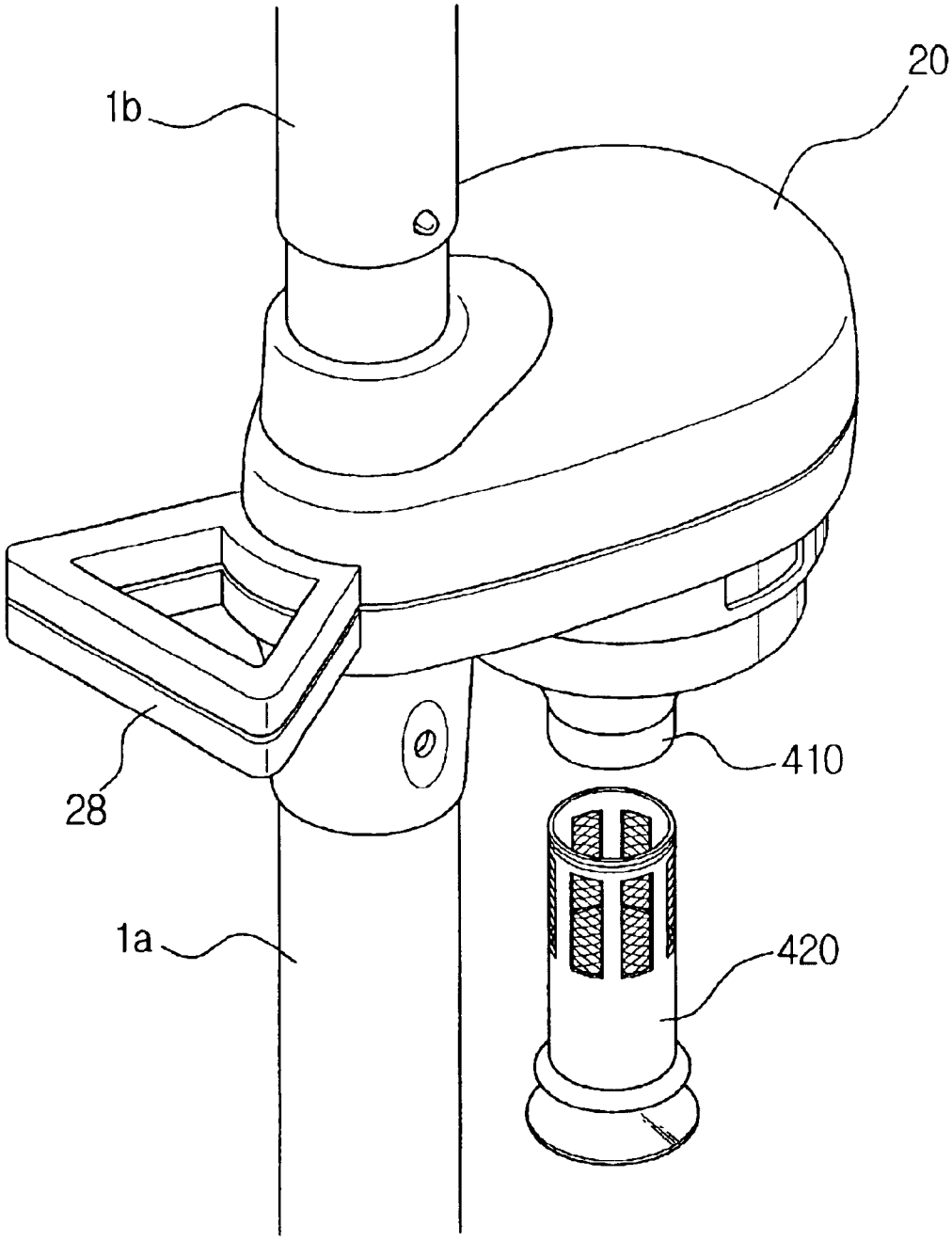
FIG. 11 is a perspective view showing the second grill member being separated from the cyclone body for dust removal in the cyclone-type dust-collecting apparatus according to the preferred embodiment of the present invention.

The operational steps of the cyclone-type dust-collecting apparatus for use in a vacuum cleaner, constructed as described above according to the present invention, will be described below with reference to FIGS. 10 through 12.

As shown in FIGS. 10 and 12, when in use, the cyclone-type dust-collecting apparatus S (FIG. 12), according to the present invention, is mounted on the extension pipes 1*a*, 1*b*, as in the conventional vacuum cleaner. As the cleaning operation begins, dust-laden air is drawn into the cleaner by the suction force generated at the suction port, and drawn into the cyclone body 20 (FIGS. 10 and 11) through the inflow port 25 in a diagonal direction. A whirling air current is generated from the drawn air and the generated air current moves downwardly into the lower portion of the dust-collecting chamber 30. During this process, dust is separated from the air by the centrifugal force of the whirling air current, and is collected in the dust-collecting chamber 30. According to the present invention, the flow direction of the whirling air current can be maintained constant and stable. Due to high directionality of the air flow, dust separation is efficient, and the reverse flow of dust can be prevented.

The air current is turned upwardly from the bottom of the dust-collecting chamber 30 and is discharged into the cleaner body through the grill portion 430 of the grill assembly 400, through outflow port 27 and into outflow pipe 26. Here, some of the air is discharged to the cleaner body through the clearance defined between the lower end of the second grill member 420 and the plate 453 of the dust reverse flow preventing member 450. At this time, some dust entrained in the upwardly flowing air current of the dust-collecting chamber 30 is blocked by the plate 453 of the dust reverse flow preventing member 450, and is returned to the whirling air current. Dust still remaining in the air after the plate 453 is discharged together with the air through the grill portion 430 of the grill assembly 400. Again, larger particles of the dust are blocked by the fine holes of the grill portion 430, and are returned to the whirling air current.

Meanwhile, as the cleaning operation continues for a long period of time, fine dust that would normally accumulates over, and thus blocks, the fine holes of the grill portion 430 of the grill assembly 400. This problem can be solved according to the present invention. That is, as the second grill member 420 alone can be separated from the grill assembly 400 and dust over the grill portion 430 can be easily removed by washing or the like. In conventional cleaners, the cyclone-type dust-collecting apparatus S has to be separated from the extension pipes of the cleaner in order to remove dust from the grill assembly. This process was not only cumbersome for the user, but also very unhygienic because the dust would become dispersed in the air. According to the present invention, the user only needs to separate the second grill member 420 for cleaning or washing of the grill portion 430, without having to separate the cyclone-type dust-collecting apparatus from the extension pipe.

As described above, the second grill member 420 having the grill portion 430, i.e., the portion that is easily contaminated by the dust, is removably screwed to the first grill member 410 that is secured to the cyclone body 20. Accordingly, the user can remove the dust of the grill portion 430 after simply separating the second grill member 420. As the user can clean the grill portion 430 of the grill assembly 400 in a convenient way, cleaner maintenance and care can be performed easily.

According to the present invention, since the secondary handle 28 is formed on the cyclone body 20 for a user to grip, the user can use the vacuum cleaner with greater ease and convenience.

In conclusion, an improved vacuum cleaner that could satisfy the demands of the users can be provided.

Further, the cyclone-type dust-collecting apparatus is provided with the guiding member 29 formed in the sidewall of the inflow port 25 of the cyclone body 20, contributing to improved directionality of the whirling air current. As a result, stability and directionality of the whirling air current can be improved, and efficiency in operation and reverse flow of the dust can be prevented.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A cyclone dust-collecting apparatus for use in a vacuum cleaner, comprising:

a cyclone body having an inflow port and an outflow port, the cyclone body being capable of forming a whirling air current from dust-laden air drawn into the vacuum cleaner through the inflow port;

a dust-collecting chamber removably connected with the cyclone body, for collecting dust separated from the drawn air in the whirling air current; and a grill assembly disposed at the outflow port of the cyclone body for preventing reverse flow of dust through the outflow port of the cyclone body, the grill assembly comprising:

a first grill member having a supporting portion supported on the outflow port of the cyclone body;

a second grill member removably connected to a lower opening of the first grill member and having an outer circumference; and a grill portion provided to define a passage in fluid communication with the outflow port in the outer circumference of the second grill member.

2. The cyclone dust-collecting apparatus of claim 1, wherein the first grill member further comprises a female-screw portion formed on an inner circumference of the lower opening, and the second grill member comprises a male-screw portion formed on an outer circumference of upper portion corresponding to the female-screw portion.

3. The cyclone dust-collecting apparatus of claim 1, wherein the grill portion is formed by fitting a mesh filter in the second grill member, the mesh filter comprising a plurality of fine holes, and the second grill member comprising a plurality of window-shaped openings formed in the outer circumference in a radial direction.

4. The cyclone dust-collecting apparatus of claim 3, wherein the mesh filter comprises:

a filter frame comprising an upper ring, a lower ring, and two or more ribs connecting upper and lower rings; and a net insert-molded in the filter frame so as to be placed in the openings partitioned by the ribs of the filter frame.

5. The cyclone dust-collecting apparatus of claim 4, wherein the lifter frame is formed of a plastic, and upper and lower rings of the filter frame are vapor-deposited onto a corresponding portion of the second grill member so that the filter frame is inserted in the second grill member, thereby constituting the mesh filter.

6. The cyclone dust-collecting apparatus of claim 4, wherein the filter frame is formed of rubber and is retained in place by an interference-fit relative to the second gnu member, thereby constituting the mesh filter.

7. The cyclone dust-collecting apparatus of claim 1, wherein the grill portion is formed by direct boring of a plurality of fine holes in the outer circumference of the second grill member.

8. The cyclone dust-collecting apparatus of claim 1, wherein the grill assembly comprises a dust reverse flow preventing member disposed at the lower opening of the second grill member for deflecting the dust entrained in the upwardly directed air current of the dust collecting chamber.

9. The cyclone dust-collecting apparatus of claim 8, wherein the dust reverse flow preventing member comprises:

a cylinder press-fit through the lower opening of the second grill member, and comprising upper and lower supporting portions having two or more ribs;

a shaft supported by upper and lower supporting portions; and a plate connected to an end of the shaft, disposed at a predetermined distance from a lower end of the second grill member.

10. The cyclone dust-collecting apparatus of claim 9, wherein the cylinder comprises a spiral guide formed therein for guiding the flow of air being discharged therethrough.

11. The cyclone dust-collecting apparatus of claim 9, wherein the cylinder and the plate comprise rubber.

12. The cyclone dust-collecting apparatus of claim 9, the plate is formed in a conical shape.

13. The cyclone dust-collecting apparatus of claim 1, wherein the cyclone body comprises a secondary handle protruding from an extension pipe of the vacuum cleaner to enable a user to grip the extension pipe.

14. The cyclone dust-collecting apparatus of claim 13, wherein the cyclone body comprises upper and lower bodies which are separately formed and mate with each other, and the secondary handle comprises a pair of handle portions in symmetrical shape formed on upper and lower bodies and mated with each other.

15. The cyclone dust-collecting apparatus of claim 1, wherein the cyclone body comprises a guiding surface formed at a sidewall of the inflow port, for guiding the flow of air drawn in through the inflow port and thereby improving a directionality of the drawn air, the guiding surface being formed at a predetermined radius of curvature.

16. The cyclone dust-collecting apparatus of claim 15, wherein the radius of curvature of the guiding surface is smaller than the radius of curvature of the inner circumference of the cyclone body.

* * * * *